US009291132B2

(12) United States Patent
Rosu et al.

(10) Patent No.: US 9,291,132 B2
(45) Date of Patent: Mar. 22, 2016

(54) FUEL PUMP ASSEMBLY

(75) Inventors: Cristian A. Rosu, Gillingham (GB); Rainer Werner Jorach, Remseck (DE)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 84 days.

(21) Appl. No.: 14/123,256

(22) PCT Filed: May 16, 2012

(86) PCT No.: PCT/EP2012/059177

§ 371 (c)(1),
(2), (4) Date: Dec. 20, 2013

(87) PCT Pub. No.: WO2012/163686

PCT Pub. Date: Dec. 6, 2012

(65) Prior Publication Data

US 2014/0102417 A1 Apr. 17, 2014

(30) Foreign Application Priority Data

Jun. 2, 2011 (EP) ..... 11168571

(51) Int. Cl.

| | |
|---|---|
| ***F02M 37/04*** | (2006.01) |
| ***F02M 39/00*** | (2006.01) |
| ***F02M 59/10*** | (2006.01) |
| ***F02M 59/44*** | (2006.01) |
| ***F02M 63/00*** | (2006.01) |
| ***F04B 1/04*** | (2006.01) |

(52) U.S. Cl.

CPC ..... *F02M 39/005* (2013.01); *F02M 59/102* (2013.01); *F02M 59/44* (2013.01); *F02M 59/442* (2013.01); *F02M 63/0001* (2013.01); *F04B 1/0426* (2013.01)

(58) Field of Classification Search

CPC ..... F02M 59/10; F02M 59/102; F02M 59/44; F04B 53/04; F04B 53/08; F04B 53/06; F04B 1/0408; F04B 1/122; F04B 1/124; F04B 27/0409; F04B 27/0428; F04B 27/1036; F04B 27/109

USPC ..... 123/507

See application file for complete search history.

(56) References Cited

U.S. PATENT DOCUMENTS

| | | | | |
|---|---|---|---|---|
| 4,082,072 | A * | 4/1978 | Johnson | 123/495 |
| 4,184,816 | A | 1/1980 | Rapp et al. | |
| 2008/0264377 | A1 | 10/2008 | Stewart et al. | |

FOREIGN PATENT DOCUMENTS

| | | | |
|---|---|---|---|
| CN | 1372074 | A | 10/2001 |
| CN | 101903639 | A | 12/2010 |

(Continued)

*Primary Examiner* — Hung Q Nguyen
(74) *Attorney, Agent, or Firm* — Thomas N. Twomey

(57) ABSTRACT

A high-pressure fuel pump assembly for use in an internal combustion engine is disclosed. The fuel pump assembly comprises a pumping plunger for pressurizing fuel within a pump chamber during a plunger pumping stroke, and being slidably received in a plunger bore; a rider member co-operable with a drive; and an interface member for imparting drive from the rider member to the pumping plunger to perform the plunger pumping stroke, the interface member having an interface side co-operable with the rider member). The pumping plunger comprises fluid delivery means for delivering fuel from the pump chamber to one or more contact surfaces of the pumping plunger, thereby to lubricate the contact surfaces.

14 Claims, 6 Drawing Sheets

(56) References Cited

FOREIGN PATENT DOCUMENTS

| | | | |
|---|---|---|---|
| EP | 1 705 368 | A1 | 9/2006 |
| EP | 2 048 359 | A1 | 4/2009 |
| EP | 2 050 952 | A1 | 4/2009 |
| EP | 2 088 309 | A1 | 8/2009 |
| GB | 2 237 074 | A | 4/1991 |
| JP | 2002-276508 | A | 9/2002 |
| JP | 2003-269296 | A | 9/2003 |
| JP | 2010-203361 | A | 9/2010 |

* cited by examiner

FUEL PUMP ASSEMBLY

CROSS REFERENCE TO RELATED APPLICATIONS

This application is a national stage application under 35 U.S.C. 371 of PCT Application No. PCT/EP2012/059177 having an international filing date of 16 May 2012, which designated the United States, which PCT application claimed the benefit of European Patent Application No. 11168571 filed 2 Jun. 2011, the entire disclosure of each of which are hereby incorporated herein by reference.

FIELD OF THE INVENTION

This invention relates to pump assemblies suitable for use in common rail fuel injection systems of internal combustion engines. In particular, though not exclusively, the invention relates to an improved pumping plunger for a high-pressure fuel pump, and an improved fuel pump of the type having at least one pumping plunger that is driven by an engine-driven cam or other appropriate drive arrangement.

BACKGROUND TO THE INVENTION

Examples of common rail fuel pumps of radial pump design are known from, for example, EP-B-1705368 and EP-A-2050952. FIG. 1 of the accompanying drawings is a sectional view of one known radial fuel pump, which will now be described to illustrate the prior art.

The pump 100 of FIG. 1 comprises three pumping plungers 102 that are arranged at equi-angularly spaced locations around an engine-driven cam 104. Each plunger 102 is mounted within a plunger bore 106 provided in the housings 107*a* of respective pump heads 107. The pump heads 107 are mounted to a main pump housing 108 of the pump 100.

As the cam 104 is driven in use, the plungers 102 are caused to reciprocate within their bores 106 in a phased, cyclical manner. As the plungers 102 reciprocate, each causes pressurisation of fuel within a pump chamber 109 defined at one end of the associated plunger bore 106. The delivery of fuel from the pump chambers to a common high pressure supply line (not shown) is controlled by means of delivery valves (not shown). The high pressure line supplies fuel to a common rail, or other accumulator volume, for delivery to downstream injectors of a common rail fuel system.

The cam 104 carries a cam ring, or cam rider 110, which is provided with a plurality of flats 112, one for each plunger 102. An intermediate member in the form of a tappet 114 co-operates with each of the flats 112 on the cam rider 110 and couples to an associated plunger 102 so that, as the tappet 114 is driven upon rotation of the cam 104, drive is imparted to the plunger 102. As each tappet 114 is driven radially outward, its respective plunger 102 is driven to reduce the volume of the pump chamber. This part of the pumping cycle is referred to as the pumping stroke of the plunger 102, during which fuel within the associated pump chamber is pressurised to a relatively high level.

As the rider 110 rides over the cam 104 to impart drive to the tappets 114 in an axial direction, a base surface of each tappet 114 is caused to translate laterally over a co-operating region of an associated flat 112 of the rider 110. This translation of the tappets 114 with respect to the rider 110 causes frictional wear of the tappets 114 and the rider 110. Frictional wear particularly occurs at lateral edges of the tappets 114.

The rider 110 tends to turn on its axis during operation, so that the flats 112 tend to move away from perpendicular with respect to the axes of the respective pumping plungers 102. This means that the base surfaces of the tappets 114 tend to meet the flats at an inclined angle. This gives rise to an edge contact between the tappets 114 and the rider 110, which can exacerbate the problem of frictional wear. In particular, the edge contact results in a local temperature increase, which undesirably heats other components within the fuel pump assembly.

Due to the turning movement of the rider 110, the tappets 114 experience a torque which in turn gives rise to side loads that act on the plungers 102. As a result, frictional wear also occurs where each plunger 102 engages its respective tappet 114. The plungers 102 are guided in the bores 106, so the torque acting on the tappets 114 causes the tappets 114 to become inclined with respect to the plungers 102. The contact between the end of each plunger 102 and the corresponding tappet 114 is therefore also an edge contact, which can again lead to a high wear rate and localised heat generation.

The side loads acting on the plungers 102 also give rise to wear at the interfaces between the plungers 102 and the bores 106 in the head housings 107*a*. Wear at the plunger-bore interface can result in loss of volumetric efficiency of the pump, and in severe cases in plunger seizure and loss of pumping function.

An additional problem that arises when wear occurs between the rider 110 and the tappets 114, between the tappets 114 and the plungers 102, and between the plungers 102 and the head bores 106 is that wear debris can be produced. If such debris becomes entrained at an interface, for example between the tappet 114 and the rider 110, a dramatic increase in the wear rate can occur, which can lead to catastrophic failure of the pump.

It is known in some fuel pumps to omit the tappets, and instead to provide pumping plungers with integral interface members in the form of feet as described in, for example, EP-A-2048359. In these cases, similar wear problems to those described above arise at the interfaces between the plungers and the bores, and between the plunger feet and the rider flats.

It is known in the prior art to use fuel to lubricate the side contact surfaces of fuel pump plungers. For example, JP 2002 276508 describes a fuel pump in which a pumping plunger is provided with grooves to direct fuel from a fuel inlet passage to lubricate side contact surfaces of the plunger. EP-A-2088309 describes a fuel pump in which fuel can leak from the pump chamber between a plunger and its corresponding bore, providing a degree of lubrication to the side contact surfaces, and an arrangement of passages is provided in the pump housing to allow the leakage fuel to return to drain.

Against this background, it would be desirable to provide a fuel pump assembly in which the above-mentioned problems are reduced or mitigated.

SUMMARY OF THE INVENTION

From a first aspect, the present invention resides in a high-pressure fuel pump assembly for use in an internal combustion engine. The fuel pump assembly comprises a pumping plunger for pressurising fuel within a pump chamber during a plunger pumping stroke and being slidably received in a plunger bore, a rider member co-operable with a drive, and an interface member for imparting drive from the rider member to the pumping plunger to perform the plunger pumping stroke, the interface member having an interface side co-operable with the rider member. The pumping plunger comprises fluid delivery means for delivering fuel from the pump chamber to one or more contact surfaces of the pumping plunger, thereby to lubricate the contact surfaces.

By delivering fluid to the contact surfaces of the pumping plunger, lubrication of the pumping plunger is substantially improved in the present invention. As a result, wear rates in the pump assembly of the invention are lower than in previously-known pump designs, and the durability and reliability of the pump assembly is improved. Furthermore, because of the increased lubrication and cooling provided by the invention, it may not be necessary to coat or otherwise treat components of the pump assembly such as the pumping plunger, thus saving manufacturing costs.

Unlike in the known arrangements described above, in the present invention the fuel delivery means is comprised in the pumping plunger and communicates with the pump chamber, so that the contact surfaces of the pumping plunger are lubricated by pressurised fuel that is sourced from the pump chamber and directed to the contact surfaces by the fuel delivery means. To avoid loss of pressurised fuel, the fluid delivery means preferably deliver fuel to contact surfaces of the pumping plunger that are in sliding, abutting or other close contact with adjacent surfaces. Said another way, in the present invention, there is minimal flow of fuel from the pump chamber to the contact surfaces by way of the fluid delivery means.

Preferably, the fluid delivery means includes a restrictor for restricting the pressure of fuel in the fluid delivery means during the pumping stroke. The restrictor may be remote from the or each of the contact surfaces. In one embodiment, for example, a first end of the pumping plunger is received in the pump chamber, and the restrictor opens into the pump chamber at the first end of the pumping plunger. By restricting the pressure and hence the quantity of fuel in the fuel delivery means during the pumping stroke, the restrictor limits the loss of efficiency that would otherwise result if the fuel in the fluid delivery means were pressurised to the same pressure as the fuel in the pump chamber.

In one embodiment of the invention, the interface member comprises a tappet having a plunger contact surface for cooperation with a contact face of the pumping plunger. The fluid delivery means may serve to deliver fuel from the pump chamber to the contact face of the pumping plunger, thereby to provide lubrication between the contact face of the pumping plunger and the plunger contact surface of the tappet. The fluid delivery means may, for example, comprise an axially-extending passage in the pumping plunger to deliver fuel from the pump chamber to the contact face of the pumping plunger. In this way, wear problems at the interface where the pumping plunger meets the tappet can be mitigated or avoided.

The tappet may comprise passage means for providing fluid communication between the plunger contact surface and the interface side of the tappet, thereby to provide lubrication between the interface side of the tappet and the rider member. In such an arrangement, the fluid delivery means in the plunger may communicate with the passage means in the tappet. The additional lubrication thus achieved helps to reduce or avoid wear problems at the interface between the tappet and the rider member.

In an alternative embodiment, in which a tappet is not provided, the interface member may comprise a foot of the pumping plunger, and the fluid delivery means may serve to deliver fuel from the pump chamber to the interface side of the pumping plunger, thereby to provide lubrication between the interface side of the pumping plunger and the rider member.

The fluid delivery means may serve to deliver fuel from the pump chamber to a side surface of the pumping plunger, thereby to provide lubrication between the side surface of the pumping plunger and the plunger bore. In this way, wear problems at the sliding interface between the pumping plunger and the plunger bore can be reduced or avoided. In one example, the fluid delivery means comprises one or more radially-extending passages in the pumping plunger to deliver fuel to the side surface of the pumping plunger.

The fluid delivery means may comprise an annular groove in the side surface of the pumping plunger, which assists in retaining lubricant at the interface by acting as a reservoir for lubricant, further increasing the benefit of improved cooling and lubrication. When present, the radially-extending passages may communicate or open into the annular groove.

Similarly, in other embodiments of the invention, the fluid delivery means may comprise at least one recess in the or at least one of the contact surfaces of the pumping plunger. The or each recess is fed with fuel by the fluid delivery means and serves to assist lubrication and cooling at the contact surface by acting as a reservoir for lubricant.

The lubrication regime acting at the or each contact surface of the pumping plunger in use is preferably boundary lubrication, in which the load between the contact surface and an adjacent surface is carried by surface contact (specifically asperity contact), or elastohydrodynamic lubrication, in which the load between the contact surface and an adjacent surface is supported by viscous resistance of the lubricant in addition to some surface contact. Preferably, fluid film lubrication regimes such as hydrostatic and hydrodynamic lubrication, in which the surfaces are separated by a film of lubricant that bears the load between the surfaces, do not operate at the contact surfaces of the pumping plunger.

In a second aspect of the invention, a pumping plunger for pressurising fuel within a pump chamber of a high-pressure fuel pump is provided. The pumping plunger comprising a pumping end, one or more contact surfaces, and fluid delivery means for delivering fuel from the pump chamber to the or each contact surface. The fluid delivery means comprises a restrictor remote from the or each contact surface.

In one embodiment, the pumping plunger comprises a cylindrical plunger stem having first and second opposite ends, wherein the first end comprises the pumping end and the second end defines the or one of the contact surfaces. The contact surface co-operates with a tappet in use, and the fluid delivery means is arranged to deliver fuel from the pump chamber to the contact surface to lubricate the contact between the plunger stem and the tappet.

The fuel pump assembly of the first aspect of the invention may comprise a pumping plunger according to the second aspect of the invention.

Preferred and/or optional features of the first aspect of the invention may be included, alone or in appropriate combination, in the second aspect of the invention also, and vice versa.

BRIEF DESCRIPTION OF THE DRAWINGS

The present invention will now be described, by way of example only, with reference to the remaining accompanying drawings, in which like reference numerals are used for like features, and in which.

DETAILED DESCRIPTION OF PREFERRED EMBODIMENTS OF THE INVENTION

Figure 2:
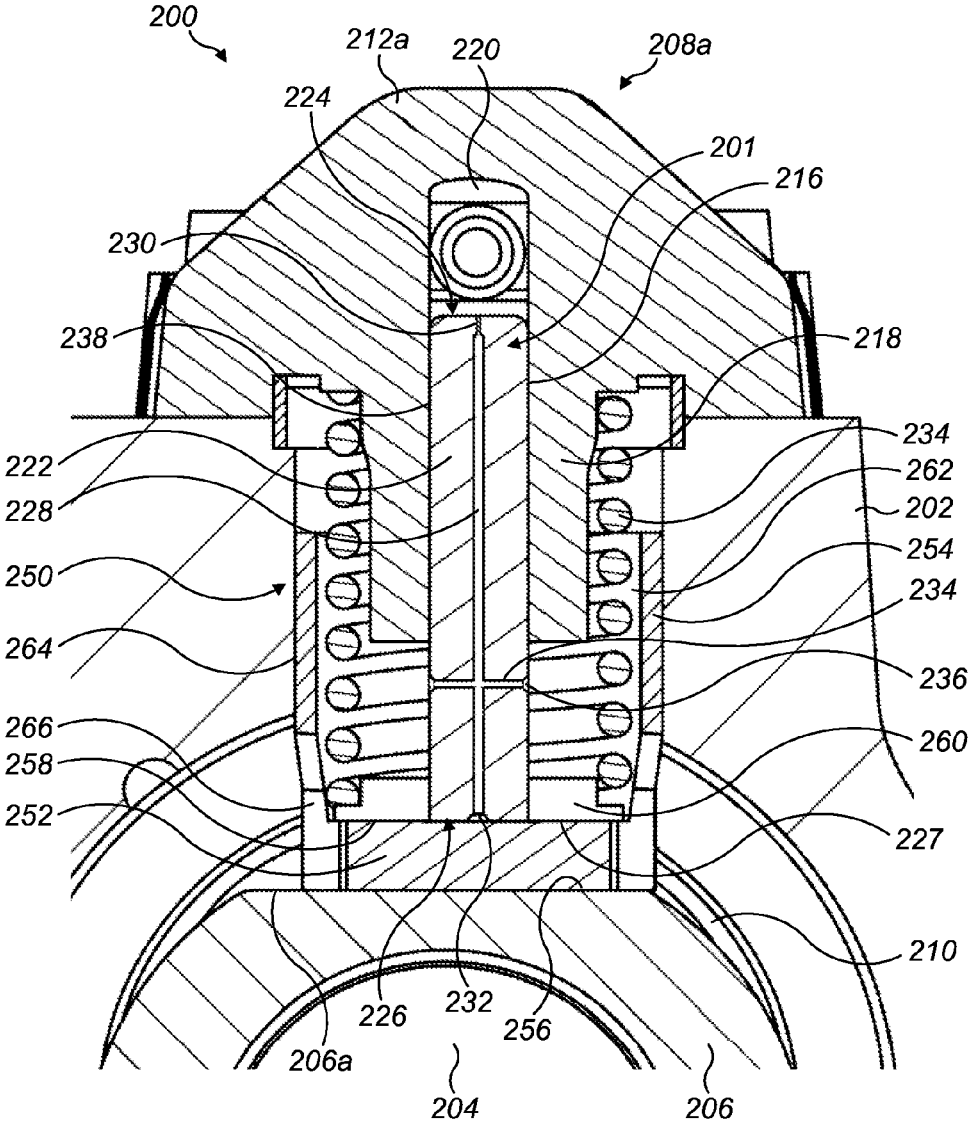
FIG. 2 is a cross-sectional view of part of a fuel pump assembly according to a first embodiment of the present invention and having a pumping plunger.

FIG. 2 shows part of a high pressure fuel pump 200 suitable for use in the fuel injection system of a compression ignition internal combustion engine. In particular, the fuel pump 200 is suitable for use in delivering high pressure fuel to a common rail of a common rail fuel injection system (not shown).

Figure 1:
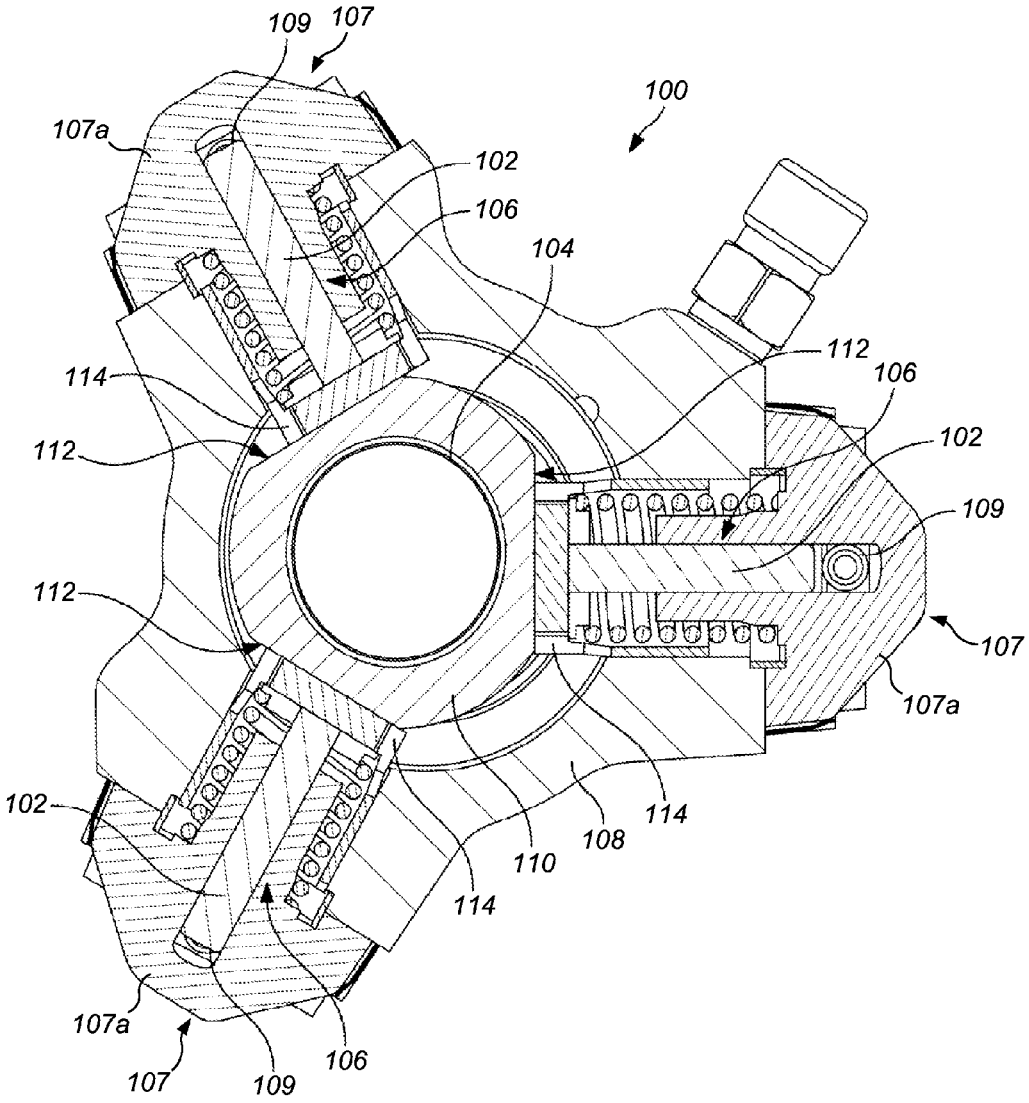
FIG. 1 (PRIOR ART)
FIG. 1 of the accompanying drawings, which has already been referred to above, is a cross-sectional view of a known fuel pump assembly.

Many aspects of the fuel pump 200 in FIG. 2 are known, for example from fuel pumps of the type shown in FIG. 1 and described in EP-B-1705368, EP-A-2050952 and EP-A-2048359, and these parts will only be described briefly. However, the fuel pump 200 comprises improved pumping plungers 201, which help to reduce frictional wear within the pump. Advantageously, by reducing frictional wear, the pump 200 is able to operate at an output pressure in excess of that possible with known pump designs, and the durability and reliability of the pump 200 can be improved.

The general arrangement of the pump 200 is as shown in FIG. 1. Accordingly, the pump 200 of FIG. 2 includes a main pump housing 202 through which an engine-driven drive shaft (not shown) extends. The drive shaft carries a cylindrical cam 204 (shown only partially in FIG. 2) that extends along a central cam axis extending perpendicularly to the plane of the drawing. The cam 204 carries a rider member in the form of a cam rider (or cam ring) 206 (again, shown only partially in FIG. 2) which is provided with a plurality of flats 206*a*, only one of which is shown in FIG. 2.

A plurality of pump heads 208*a*, only one of which is shown in FIG. 2, are mounted on the main pump housing 202 at radial locations about the cam axis, with the cam 204 extending through an internal chamber or volume 210 provided in the main pump housing 202. Each pump head 208*a* includes a respective pump head housing 212*a*.

In this example, three pump heads are provided (as shown in FIG. 1), and the pump heads are substantially identical to one another. The structure of one pump head 208*a* will now be described, and the skilled reader will appreciate that this description applies to the other pump heads also.

The pump head 208*a* includes a pumping plunger 201 which is reciprocable within a blind plunger bore 216 to perform a pumping cycle having a pumping stroke (or forward stroke) and a spring-assisted return stroke. The plunger bore 216 is defined partly within the pump head housing 212*a* and partly within a plunger support tube 218 which extends from a lower surface of the pump head housing 212*a*. The blind end of the bore 216 defines, together with the pump head housing 212*a*, a pump chamber 220. Reciprocating movement of the plunger 201 within the bore 216 causes pressurisation of fuel within the pump chamber 220 during a pumping stroke. Fuel is admitted to the pump chamber 220 through an inlet valve (not shown) during a filling stroke of the plunger 201, and fuel is delivered from the pump chamber 220 at high pressure through an outlet valve (not shown) during the pumping stroke.

Figure 3A:
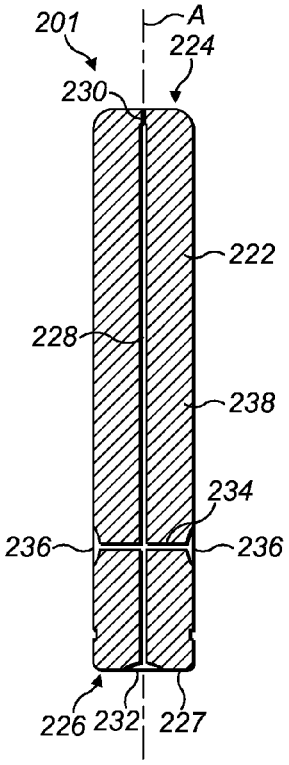
FIGS. 3(*a*), 3(*b*) and 3(*c*) are cross-sectional, cut-away perspective and side views, respectively, of the pumping plunger of the fuel pump assembly of FIG. 2.
Figure 3B:
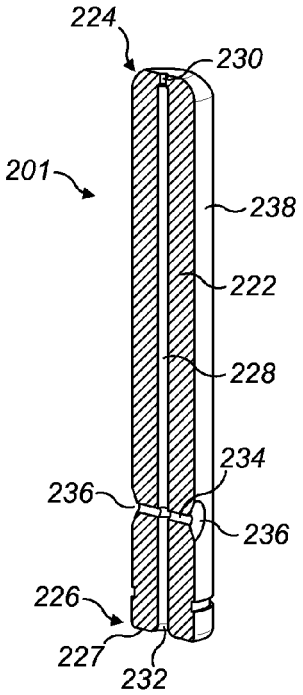
Figure 3C:
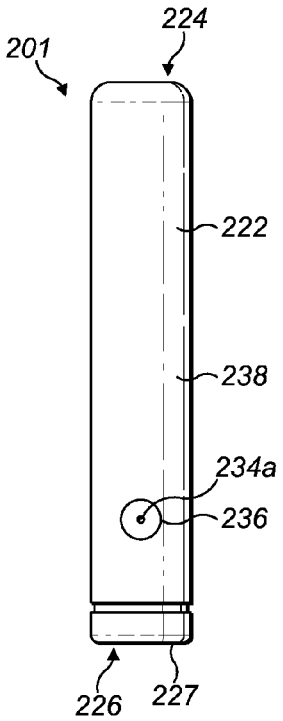

Referring additionally to FIGS. 3(*a*), (*b*) and (*c*), the plunger 201 broadly comprises a generally cylindrical stem 222 defining a plunger axis A (see FIG. 3(*a*)). A first or upper end 224 of the plunger 201 faces the pump chamber 220, and a second or lower end 226 of the plunger 201, opposite the first end, defines a contact face 227 that cooperates with an intermediate drive member in the form of a tappet 250, as will be explained in more detail below.

In the illustrated example, the diameter of the stem 222 is approximately 6.5 mm, although different stem diameters can be selected. For example, another embodiment has a plunger stem diameter of approximately 7.5 mm. In general, the plunger stem diameter is preferably between approximately 6 mm and approximately 8 mm.

The plunger 201 is made from carbon steel (for example 16MnCr5), alloy steel (for example EN ISO 683-17 100Cr6+AC), or high speed steel (for example M50, M2) and may be coated with a diamond-like carbon (DLC) coating to make it more hard-wearing and to reduce friction. Whilst a coating is not always essential, it is particularly beneficial in high pressure or high speed pumps. Alternative materials and coatings may also be used as appropriate, depending on the structure of the pump and its application.

The plunger 201 includes an axially-extending throughbore or axial passage 228. A restriction orifice or restrictor 230, comprising a reduced-diameter section of the axial passage 228, is provided adjacent to the first end 224 of the plunger 201, such that the restrictor 230 opens into the pump chamber 220. At the second end 226 of the plunger 201, the axial passage 228 opens into a notch or recess 232 provided in the contact face 227 of the plunger 201. The plunger 201 also includes a first cross passage 234, which extends across the width of the plunger stem 222 perpendicular to and intersecting the plunger axis A. The cross passage 234 therefore intersects the axial passage 228. At each of its ends, the cross passage 234 opens into a respective recess 236 in the generally cylindrical side surface 238 of the stem 222 of the plunger 201.

A second cross passage 234*a*, visible in FIG. 3(*c*), extends perpendicularly to both the first cross passage 234 and the axial passage 228, in a direction normal to the plane of FIGS. 2 and 3(*a*). The second cross passage 234*a* intersects the axial passage 228 at the same axial position as the first cross passage 234. As for the first cross passage 234, the second cross passage 234*a* opens at each of its ends into a recess 236 in the side surface 238 of the plunger stem 222.

Referring again to FIG. 2, and as noted above, the contact face 227 of the plunger 201 cooperates with a tappet 250 that serves as an intermediate drive member between the plunger 201 and the rider 206. The tappet 250 is generally cup-shaped, and comprises a discoid base member 252 and a generally cylindrical wall member 254 upstanding from the base member 252. The base member 252 defines a rider contact surface 256, and an opposed plunger contact surface 258. The rider contact surface 256 is in sliding contact with the rider 206, and the contact face 227 of the plunger 201 abuts the plunger contact surface 258. In this way, the base member 252 of the tappet 250 transfers drive from the rider 206 to the plunger 201.

A spring seat member 260 in the form of an annular insert or washer is received within the tappet 250. The second end 226 of the plunger extends through the spring seat member 260 to contact the base member 252 of the tappet 250. The spring seat member 260 defines a stepped spring seat for receiving a helical spring 234. The spring 234 is disposed between the spring seat member 260 and the pump head housing 212*a*. The spring 234 assists the pumping plunger 201 in performing a return or filling stroke following a pumping stroke.

The wall member 254 of the tappet 250 defines a volume 262 in which the spring 234 is partially received. The wall member 254 is a sliding fit within a bore 264 in the main pump housing 202. The clearance between the wall member 254 and the bore 264 is dependent on manufacturing tolerances, but is preferably between approximately 40 m and 80 m.

In use of the pump 200, the internal volume 210 of the main pump housing contains fuel which serves as a lubricant for the components of the pump 200. To this end, the tappet 250 comprises vent slots 266 that allow fuel to flow between the internal volume 210 of the main pump housing and the volume 262 internal to the tappet 250. The fuel thereby serves to lubricate the sliding interface between the plunger stem 222 and the plunger bore 216, and the interface between the contact face 227 of the plunger 201 and the plunger contact surface 258 of the tappet 250.

During operation of the pump 200, as the cam rider 206 is caused to ride over the engine-driven cam 204, an axial drive force is imparted to the base member 252 of the tappet 250, causing the plunger 201 to reciprocate within the plunger bore 216. During the pumping stroke, the plunger 201 is driven radially outward from the shaft to reduce the volume of the pump chamber 220. During the plunger return stroke, which is effected by means of the spring 234, the plunger 201 is urged in a radially inward direction to increase the volume of the pump chamber 220.

As the rider contact surface 256 of the tappet 250 is driven in a radially outward direction, leading to movement of the plunger 201 along its central axis A, a degree of relative lateral sliding movement of the rider contact surface 256 occurs across the flat 206*a* of the rider 206, in a back and forth manner. This movement is well known in the prior art and results from the movement of the cam 204 carrying the cam rider 206. The tappet 250 slides across the flat 206*a* in a similar manner during the return stroke.

In the present invention, the axial passage 228 and cross passages 234, 234*a*, and the corresponding recesses 232, 236 provided in the plunger 201 together comprise fluid delivery means to assist in lubricating the interfaces between the plunger 201 and the tappet 250 and between the plunger 201 and the plunger bore 216, by supplying lubricating fuel to the interfaces in a specific and directed manner.

In particular, during the pumping stroke of the plunger 201, the increase in fuel pressure in the pump chamber 220 forces fuel into the axial passage 228, by way of the restrictor 230. From the axial passage 228, fuel is delivered to the recess 232 in the contact face 227 at the lower end 226 of the plunger 201, and therefore helps to lubricate the contact area between the plunger 201 and the plunger contact face 258 of the tappet 250. In this way, the present invention advantageously reduces wear and localised heating where the plunger meets the tappet, for example as can be caused by inclination of the tappet 250 with respect to the plunger 201 in use.

Similarly, fuel is delivered to the recesses 236 in the side surface 238 of the plunger stem 222 by way of the cross passages 234, 234*a*, and thereby serves to lubricate the sliding contact between the side surface 238 of the plunger 201 and the plunger bore 216. In this way, the present invention advantageously reduces wear and localised heating where the plunger 201 slides in the plunger bore 216, for example as can be caused by side loads acting on the plunger 201 in use.

It should be noted that, in FIG. 2, the pump 200 is shown with the plunger 201 in a position that corresponds to the start of the pumping stroke (or, equivalently, the end of the return stroke). In this position, the cross drillings 234, 234*a* are located beyond the lower end of the plunger support tube 218. However, as the plunger 201 moves to reduce the volume of the pump chamber 220 during the pumping stroke, the cross drillings 234, 234*a* move upwards into the plunger bore 216, so that fuel can be delivered to the plunger-bore interface during the pumping stroke, when side loads on the plunger 201 are at their peak.

The contact face 227 of the plunger 201 is in close contact with the plunger contact surface 258 of the tappet 250. Furthermore, when the plunger 201 moves in its pumping stroke, the contact face 227 is pressed more tightly against the plunger contact surface 258 of the tappet 250, against the resilience of the fuel in the pump chamber 220. Accordingly, minimal leakage of fuel occurs between the contact face 227 of the plunger 201 and the plunger contact surface 258 of the tappet 250 during the pumping stroke. The volumetric efficiency of the pump 200 is therefore not compromised unduly by providing fluid delivery means to connect the pump chamber 220 to the contact face 227 of the plunger 201, in the form of the restrictor 230, the axial passage 228, and the recess 232.

Similarly, the side surface 238 of the plunger stem 222 is in close sliding contact with the surface of the plunger bore 216. The plunger stem 222 to plunger bore clearance 216 is dependent on manufacturing tolerances, but is preferably between approximately 3.5 and approximately 7.5 m. Therefore, only minimal additional leakage of fuel from the pump chamber 220 occurs as a consequence of the provision of fluid delivery means to connect the pump chamber 220 to the side surface 238 of the plunger stem 222, in the form of the restrictor 230, the axial passage 228, the cross passages 234, 234*a* and the recesses 236.

It should therefore be noted that, in the present invention, the fluid delivery means provided in the plunger 201 do not give rise to a significant flow of fuel out of the pump chamber 220. Instead, the fluid delivery means serve only to deliver small quantities of lubricating fuel to the respective plunger surfaces to assist in lubricating the corresponding interfaces. However, the type or regime of lubrication at the interfaces is preferably unchanged by the presence of the fluid delivery means. For example, the lubrication regime at the interface between the plunger 201 and the tappet 250 is preferably boundary lubrication or elastohydrodynamic lubrication. The presence of the fluid delivery means to supply additional lubricant to the interface serves to improve the effectiveness of the lubrication, but does not create a hydrostatic fluid film lubrication condition at the interface.

Because the passages 228, 234, 234*a* and the recesses 232, 236 are in fluid communication with the pump chamber 220, the volume of fuel accommodated in passages 228, 234, 234*a* and the recesses 232, 236 is pressurised along with the fuel in the pump chamber 220 during the pumping stroke. However, because the fuel in the passages 228, 234, 234*a* and the recesses 232, 236 is not subsequently delivered in the output of the pump 200, the volume defined by the passages 228, 234, 234*a* and the recesses 232, 236 is so-called 'dead volume' that reduces the efficiency of the pump. The restrictor 230 serves to minimise this reduction in efficiency by creating a pressure drop at the entry point to the axial passage 228. In this way, the high pumping pressure is confined to the pump chamber 220, and the pressure increase in the passages 228, 234, 234*a* and the recesses 232, 236 is correspondingly lower.

Said another way, the restrictor 230 restricts the quantity of fuel that reaches the axial passages 228, 234, 234*a* and the recesses 232, 236 from the pump chamber 220.

In the illustrated example, the axial passage 228 has a diameter of approximately 1 mm, and the restrictor has a diameter of approximately 0.5 mm. In other examples, the restrictor may have a different diameter, for example of a value in the range from approximately 0.05 mm to approximately 0.5 mm, depending on the pump operating parameters and the desired performance requirements.

The recesses 232, 236 in the plunger surfaces, into which the passages 228, 234, 234*a* open, assist in the cooling and lubrication of the interfaces by providing a reservoir of lubricant at the interface. Additionally, the recesses 232, 236 may be shaped to help spread the lubricating fuel over the contacting surfaces.

Many variations and modifications of the present invention are possible. By way of example, some alternative embodiments and variants of the present invention will now be described.

Figure 4A:
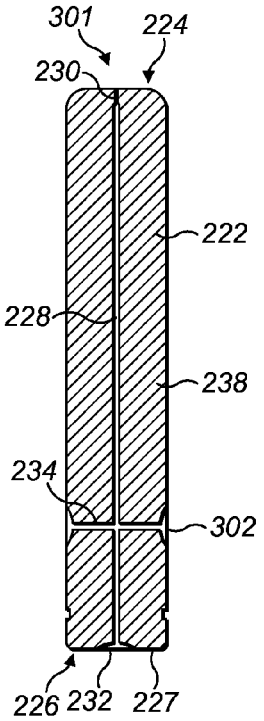
FIGS. 4(*a*) and 4(*b*) are cross-sectional and side views, respectively, of a pumping plunger for use in a second embodiment of the invention.
Figure 4B:
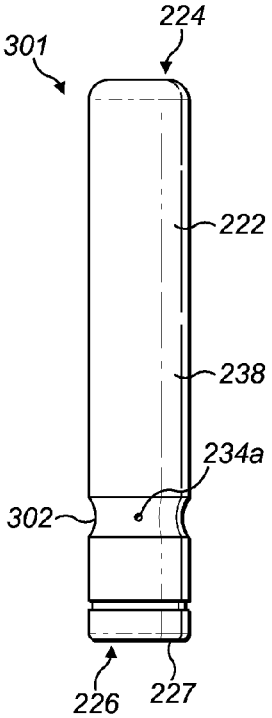

FIGS. 4(*a*) and (*b*) show a pumping plunger 301 for use in a second embodiment of the present invention, which is similar to the pumping plunger 201 of the first embodiment of the invention except in that, in the second embodiment, the cross-drillings 234, 234*a* open into an annular recess or groove 302 that extends around the plunger stem 222. In this embodiment, the annular groove 302 acts in a similar way to the recesses 236 in the plunger 201 of FIG. 2, and provides a reservoir of lubricating fuel at the interface between the plunger stem 222 and the plunger bore.

The remaining features of the plunger of FIG. 4 are as described with reference to the plunger of FIG. 3.

Figure 5A:
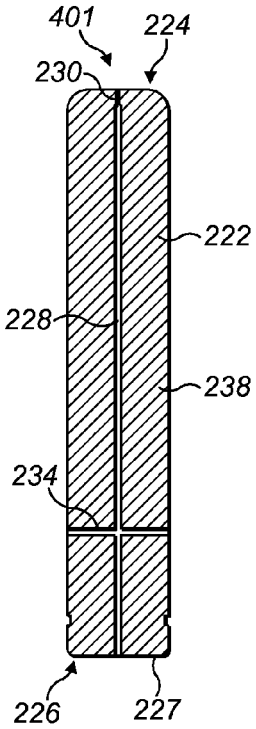
FIGS. 5(*a*) and 5(*b*) are cross-sectional and side views, respectively, of a pumping plunger for use in a third embodiment of the invention.
Figure 5B:
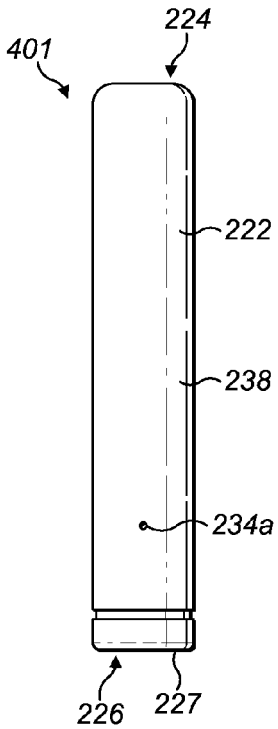

FIGS. 5(*a*) and (*b*) show a plunger 401 for use in a third embodiment of the invention. In this embodiment, the axial passage 228 opens directly onto the contact face 227 at the second end 226 of the plunger stem 222. No recess or similar feature is provided. Similarly, the cross passages 234, 234*a* open directly onto the side surface 238 of the plunger stem 222, with no recess, groove or similar feature. Due to the absence of recesses in the contact surfaces, the plunger 401 of FIG. 5 will give less benefit than the plungers 201, 301 of FIGS. 3 and 4 in terms of lubrication. However, the improvement over the prior art (for example FIG. 1) is still substantial, and the plunger 401 of FIG. 5 is less costly to manufacture.

The remaining features of the plunger of FIG. 5 are as described with reference to the plunger of FIG. 3.

Figure 6:
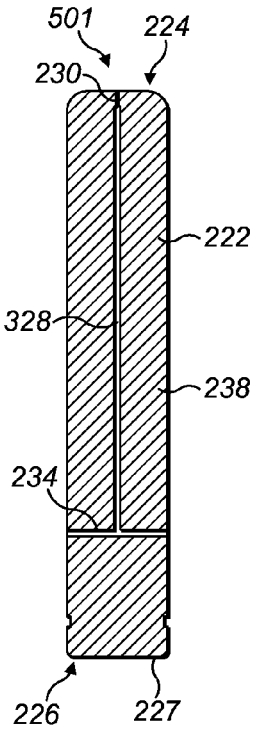
FIGS. 6 to 10 are cross-sectional views of pumping plungers for use in fourth to eighth embodiments of the invention, respectively.
Figure 7:
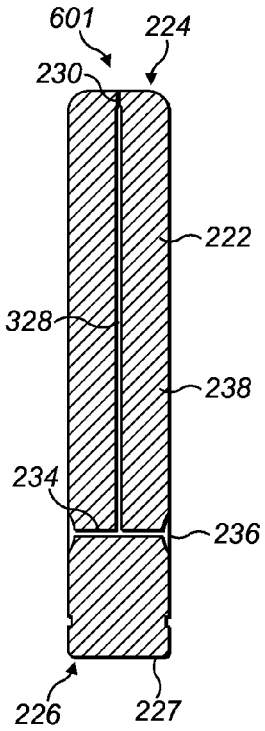
Figure 8:
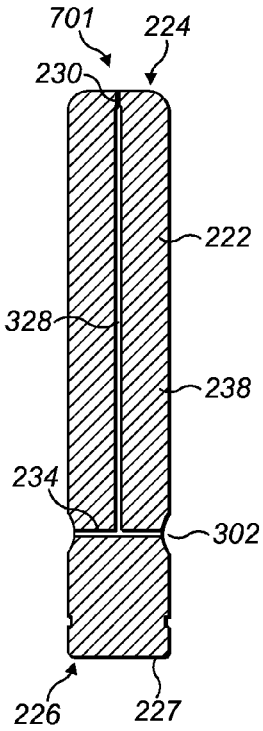

FIGS. 6 to 8 show pumping plungers for use in three further embodiments of the invention. In each case, the plungers are provided with axial passages 328 that extend only to the intersection with the cross passages 234. Therefore, in these embodiments, only the side surface 238 of the plunger stem 222 is supplied with additional lubricant. The contact face 227 at the second end 226 of the plunger stem 222 is not supplied with additional lubricant. This configuration may be useful in applications with naturally low wear rates at the interface between the plunger and the tappet, so that additional lubrication at that interface is not necessary.

Specifically, FIG. 6 shows a plunger 501 for use in a fourth embodiment of the invention, in which the cross passages 234 (only one of which is visible in FIG. 6) open directly onto the side surface 238 of the plunger stem 222, as in the fourth embodiment of the invention shown in FIG. 5.

FIG. 7 shows a plunger 601 for use in a fifth embodiment of the invention, in which the cross passages 234 (only one of which is visible in FIG. 7) open into recesses 236 in the side surface 238 of the plunger stem 222, as in the first embodiment of the invention shown in FIG. 3.

FIG. 8 shows a plunger 701 for use in a sixth embodiment of the invention, in which the cross passages 234 (only one of which is visible in FIG. 8) open into an annular groove 302 in the side surface 238 of the plunger stem 222, as in the second embodiment of the invention shown in FIG. 4.

One method of forming the truncated axial passage 328 of a plunger for use in the fourth, fifth or sixth embodiments of the invention is first to form an axial passage that extends to the lower end 226 of the plunger stem 222, and then to plug the part of the passage that extends between the cross passages 234 and the lower end 226 with a suitable blanking plug, for example of steel. The lower end 226 of the stem 222 can then be ground to form the contact face 227.

The remaining features of the plungers of FIGS. 6 to 8 are as described with reference to the plunger of FIG. 3.

Figure 9:
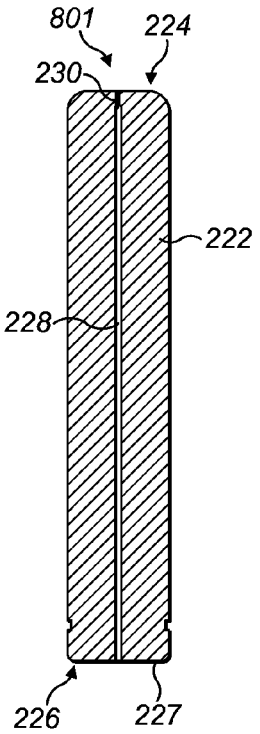
Figure 10:
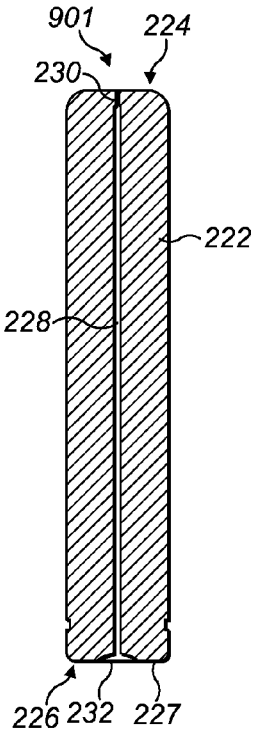

FIGS. 9 and 10 show plungers for use in two further embodiments of the invention. In these cases, the cross passages of previously-described embodiments of the invention are omitted, and instead lubricating fuel is delivered only to the contact face 227 at the lower end 226 of the plunger shaft 222. These embodiments of the invention are useful for example in applications where side loadings on the plunger are relatively low, so that additional lubrication between the plunger and the plunger bore is not necessary.

Specifically, FIG. 9 shows a plunger 801 for use in a seventh embodiment of the invention, in which the axial passage 228 extends to and opens onto the contact face 227 of the plunger stem 222, as in the third embodiment of the invention shown in FIG. 5.

FIG. 10 shows a plunger 901 for use in an eighth embodiment of the invention, in which the axial passage 228 opens into a recess 232 in the contact face 227 of the plunger stem 222, as in the first embodiment of the invention shown in FIG. 3.

The remaining features of the plungers of FIGS. 9 and 10 are as described with reference to the plunger of FIG. 3.

Figure 11:
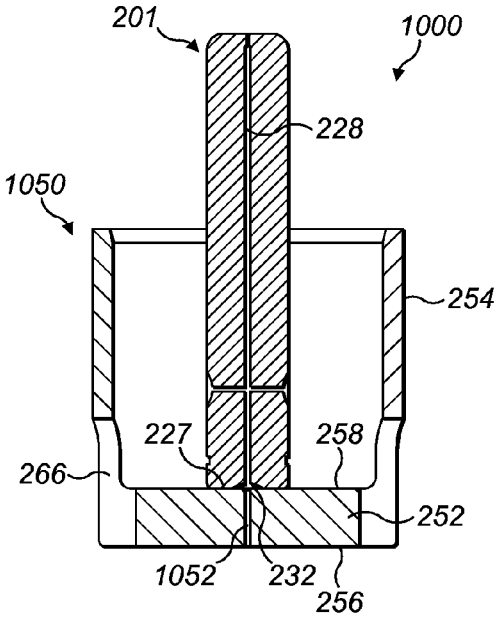
FIG. 11 is a cross-sectional view of a pumping plunger and tappet assembly for use in a ninth embodiment of the invention.

FIG. 11 shows a plunger and tappet assembly 1000 for use in a ninth embodiment of the present invention. The assembly 1000 comprises, in combination, a pumping plunger 201 according to the first embodiment of the invention, and a tappet 1050.

The tappet 1050 shares many features with the tappet 250 described with reference to FIG. 2 and those features will not be described further. Additionally, in this embodiment of the invention, the tappet 1050 includes a fluid passage 1052 that extends axially through the base member 252, connecting the plunger contact surface 258 to the rider contact surface 256.

In the assembly 1000, the fluid passage 1052 in the tappet 1050 is in fluid communication with the axial passage 228 of the plunger 201. The fluid passage 1052 in the tappet 1050 therefore acts to deliver additional lubricant to the interface between the tappet 1050 and the rider, further improving the wear performance of the pump. The recess 232 in the contact face 227 of the plunger 201 helps to maintain fluid communication between the axial passage 228 of the plunger 201 and the passage 1052 in the tappet 1050 in the event of any axial misalignment between the plunger 201 and the tappet 1050.

Figure 12:
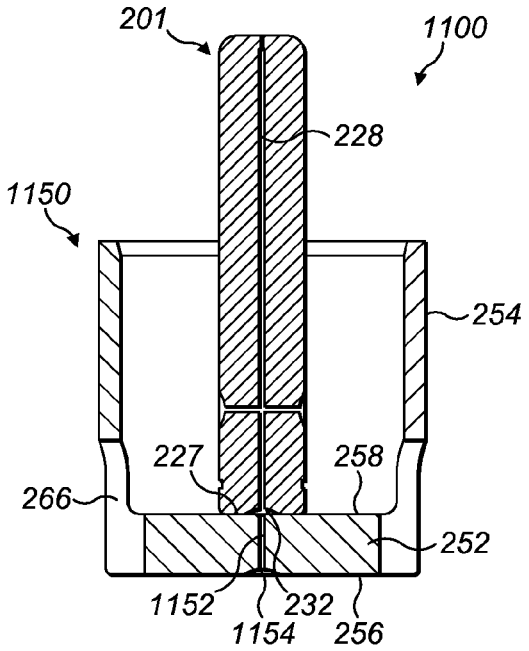
FIG. 12 is a cross-sectional view of a pumping plunger and tappet assembly for use in a tenth embodiment of the invention.

FIG. 12 shows a plunger and tappet assembly 1100 for use in a tenth embodiment of the present invention. The assembly 1100 comprises, in combination, a pumping plunger 201 according to the first embodiment of the invention, and a tappet 1150 that is identical to the tappet 1050 shown in FIG. 11, except in that the fluid passage 1152 in the tappet 1150 of FIG. 12 opens into a recess 1154 in the rider contact surface 256 of the base member 252.

Figure 13:
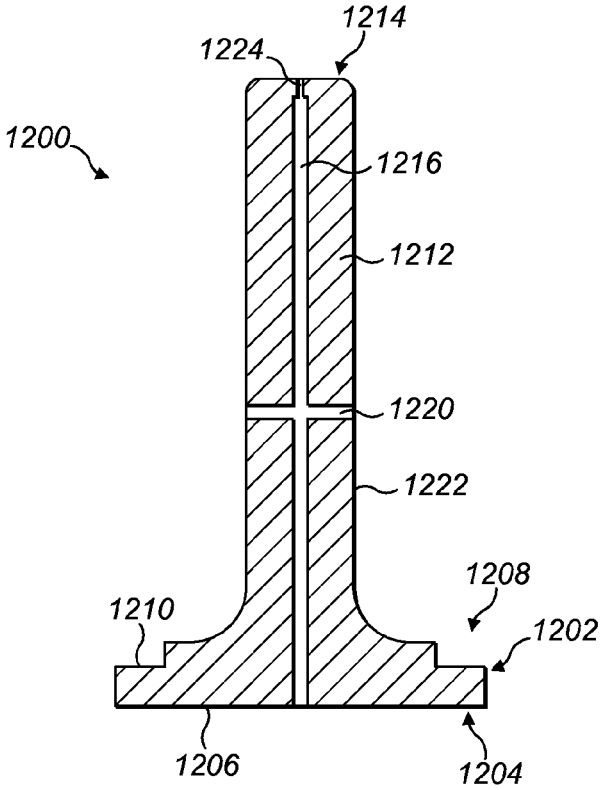
FIG. 13 is a cross-sectional view of a pumping plunger for use in an eleventh embodiment of the invention.

FIG. 13 shows a plunger 1200 for use in an eleventh embodiment of the present invention. The plunger 1200 is designed for use in a pump such as that shown in FIG. 2, but without a tappet. Instead, the plunger 1200 comprises an integral interface member in the form of a plunger foot 1202. The foot 1202 has a lower side 1204 that includes a contact face 1206 that, in use, is in sliding contact with the rider of the pump, and an upper side 1208 that provides a stepped spring seat 1210 for the return spring.

The plunger 1200 further comprises a plunger stem 1212, which extends from the upper side 1208 of the foot 1202. An upper end 1214 of the stem 1212 is received in the pump chamber.

The plunger 1200 comprises fluid delivery means in the form of an axial passage 1216 that extends from the upper end 1214 of the plunger 1200 to the lower side 1204 of the foot. The axial passage 1216 opens onto the contact face 1206 to deliver additional lubricating fuel to the plunger-rider interface.

The fluid delivery means also includes two perpendicular cross passages 1220, only one of which is shown in FIG. 13, which open onto the side surface 1222 of the plunger stem 1212 to deliver additional lubricating fluid to the plunger-bore interface.

As in previously-described embodiments of the invention, a restrictor 1224 is provided at the end of the axial passage 1216, adjacent to the upper end 1214 of the plunger 1200.

Further modifications and variations not explicitly described above may also be made without departing from the scope of the invention as defined in the appended claims.

The invention claimed is:

1. A high-pressure fuel pump assembly for use in an internal combustion engine, the fuel pump assembly comprising:

a pumping plunger for pressurising fuel within a pump chamber during a plunger pumping stroke, the pumping plunger being slidably received in a plunger bore;

a rider member co-operable with a drive; and an interface member for imparting drive from the rider member to the pumping plunger to perform the plunger pumping stroke, the interface member having an interface side co-operable with the rider member;

wherein the pumping plunger comprises fluid delivery means for delivering fuel from the pump chamber to one or more contact surfaces of the pumping plunger, thereby to lubricate the contact surfaces, wherein, the interface member comprises a tappet having a plunger contact surface for cooperation with a contact face of the pumping plunger, and wherein the fluid delivery means serves to deliver fuel from the pump chamber to the contact face of the pumping plunger, thereby to provide lubrication between the contact face of the pumping plunger and the plunger contact surface of the tappet.

2. A pump assembly according to claim 1, wherein the fluid delivery means includes a restrictor for restricting the pressure of fuel in the fluid delivery means during the pumping stroke.

3. A pump assembly according to claim 2, wherein the restrictor is remote from the or each contact surface.

4. A pump assembly according to claim 3, wherein a first end of the pumping plunger is received in the pump chamber, and wherein the restrictor opens into the pump chamber at the first end of the pumping plunger.

5. A pump assembly according to claim 1, wherein the fluid delivery means comprises an axially-extending passage in the pumping plunger to deliver fuel from the pump chamber to the contact face of the pumping plunger.

6. A pump assembly according to claim 1, wherein the tappet comprises passage means for providing fluid communication between the plunger contact surface and the interface side of the tappet, thereby to provide lubrication between the interface side of the tappet and the rider member.

7. A pump assembly according to claim 1, wherein the interface member comprises a foot of the pumping plunger, and wherein the fluid delivery means serves to deliver fuel from the pump chamber to the interface side of the pumping plunger, thereby to provide lubrication between the interface side of the pumping plunger and the rider member.

8. A pump assembly according to claim 1, wherein the fluid delivery means serves to deliver fuel from the pump chamber to a side surface of the pumping plunger, thereby to provide lubrication between the side surface of the pumping plunger and the plunger bore.

9. A pump assembly according to claim 8, wherein the fluid delivery means comprises one or more radially-extending passages in the pumping plunger to deliver fuel to the side surface.

10. A pump assembly according to claim 8, wherein the fluid delivery means comprises an annular groove in the side surface.

11. A pump assembly according to claim 1, wherein the fluid delivery means comprises at least one recess in at least one of the contact surfaces of the pumping plunger.

12. A pump assembly according to claim 1, wherein the lubrication regime acting at the or each contact surface of the pumping plunger in use is boundary lubrication or elastohydrodynamic lubrication.

13. A pumping plunger for pressurising fuel within a pump chamber of a high-pressure fuel pump, the pumping plunger comprising a pumping end, one or more contact surfaces, and fluid delivery means for delivering fuel from the pump chamber to the or each contact surface;

wherein the fluid delivery means comprises a restrictor remote from the or each contact surface.

14. A pumping plunger according to claim 13, comprising a generally cylindrical plunger stem having first and second opposite ends, wherein the first end comprises the pumping end and the second end defines the or one of the contact surfaces, wherein the contact surface co-operates with a tappet in use, and wherein the fluid delivery means is arranged to deliver fuel from the pump chamber to the contact surface to lubricate the contact between the plunger stem and the tappet.

* * * * *